US005234208A

United States Patent [19]

Bandura et al.

[11] Patent Number: 5,234,208

[45] Date of Patent: Aug. 10, 1993

[54] DOCUMENT FEEDER APPARATUS UTILIZING DRIVEN BELTS

[75] Inventors: Vitaly Bandura, Danvers; Paul St. Cyr, Middleton, both of Mass.

[73] Assignee: Production Lines, Inc., Essex, Mass.

[21] Appl. No.: 647,749

[22] Filed: Jan. 30, 1991

[51] Int. Cl.[5] ..... B65H 3/04; B65H 7/14

[52] U.S. Cl. ..... 271/34; 271/10; 271/118; 271/228

[58] Field of Search ..... 271/34, 110, 111, 117, 271/118, 228, 10

[56] References Cited

U.S. PATENT DOCUMENTS

| | | | |
|---|---|---|---|
| 1,165,521 | 12/1915 | Lockton | 271/111 |
| 3,815,900 | 6/1974 | Schulze | 271/118 |
| 3,981,493 | 9/1976 | Klappenecker et al. | 271/34 |
| 4,395,032 | 7/1983 | Hipp, Jr. | 271/117 |
| 4,431,175 | 2/1984 | Smith | 271/34 |
| 4,711,442 | 12/1987 | Rünzi | 271/118 |
| 4,822,023 | 4/1989 | Miyoshi | 271/118 |
| 4,925,062 | 5/1990 | Tsukamoto et al. | 271/118 |

FOREIGN PATENT DOCUMENTS

| | | | |
|---|---|---|---|
| 82255 | 4/1988 | Japan | 271/228 |
| 317938 | 12/1989 | Japan | 271/228 |
| 123036 | 5/1990 | Japan | 271/118 |
| 127347 | 5/1990 | Japan | 271/228 |
| 209329 | 8/1990 | Japan | 271/34 |

OTHER PUBLICATIONS

Habich, A. B., et al. "Envelope Picker-Separator" *IBM Technical Disclosure Bulletin*, vol. 19, No. 3, pp. 746–747 (Aug. 1976).

*Primary Examiner*—Robert P. Olszewski
*Assistant Examiner*—Steven M. Reiss
*Attorney, Agent, or Firm*—Paul J. Cook

[57] ABSTRACT

A document feed apparatus is provided which feeds document sheets from a stack of sheets seriatum to a position remote from the stack. Two motor driven feed belts are pivotally mounted to contact or not contact a top sheet of the stack. The belts are driven by separate motors which are activated or deactivated depending upon the top sheet position.

6 Claims, 3 Drawing Sheets

10
12
14
15
16
17
18
19
20
22
23
24
25
26
28
29
30
32a
34
36
37
38
40
41
42
46
48
50
52
56
58
60
62
64
66
68
70
72
73
74
76
3

DOCUMENT FEEDER APPARATUS UTILIZING DRIVEN BELTS

BACKGROUND OF THE INVENTION

This invention relates to a sheet feeding apparatus for feeding sheets seriatum from a stack of sheets. More particularly, this invention relates to a sheet feeding apparatus for delivering a sheet in a desired configuration to a position remote from the stack of sheets.

Prior to the present invention, document feeders have been available for transporting document sheets one by one from a stack of document sheets to an area remote from the stack. Such apparatus are use, for example in xerographic copying machines or labeling machines. It is necessary that the document sheets be transported seriatum, one at a time, in order to avoid machine jamming or misorientation of the document sheet at the delivered area remote from the stack.

It has been proposed in U.S. Pat. No. 3,815,900 to provide a document sheet feed apparatus utilizing a driven roller which contacts the top sheet of a stack of document sheets when it is desired, to remove the top sheet from the stack and is out of contact with the stack within the time period when successive sheets are removed from the stack. Contact and non-contact of the driven roller with the stack is controlled by means of a cam-cam follower arrangement. This arrangement dictates that the vertical height of the driven roller relative to the sheet stack is controlled solely by the cam surface configuration. This is undesirable since this arrangement does not account for variations in the stack height which change the stack position relative to the driven roller. The results in variation is friction force on successive top sheets which results in non-uniform sheet movement.

U.S. Pat. No. 4,395,032 discloses an apparatus for feeding document sheets one by one from a stack of sheets. The apparatus utilizes two drive belts controlled by a single motor. The driving belts are mounted in a fixed position relative to each other within a frame. The arrangement is undesirable since the drive belts cannot be moved independently to contact the top sheet of a document sheet stack. Since, oftentimes the top sheet surface is not entirely level, the friction forces exerted by each of the two belts on the top sheet differs from each other. This results in the document being skewed away from its desired position. In addition, the feeder cannot be used with varying size documents since the space between the driver belt is fixed.

Accordingly, it would be desirable to provide document sheet feeding apparatus which is efficient in reproducibly positioning documents in a desired position and configuration and which is flexible in accommodating a variety of document sheet sizes.

SUMMARY OF THE INVENTION

The present invention provides an apparatus for feeding document sheets seriatum one by one from a stack of the sheets. The apparatus includes two feed belts individually driven by a motor means positioned adjacent parallel ends of a document sheet. The driven belts are mounted each on two rotating wheels to form a drive belt unit. Each of the drive belt units are pivotally mounted about a shaft to effect either contact or non-contact of the driven belts with a top sheet on a stack of document sheets. The driven belt units are spring loaded by means of a spring mounted on the shaft in order to bias the position of the drive belt units toward the stack. A stop means is provided to limit the degree that the driven belt units are pivoted away from the stack when noncontact from the stack is desired. Optical switching means are provided for each of the drive belt units which deactivate the motor when the top sheet moves into position away from the stack to the desired position. The optical switching means permit one motor to be deactivated and one motor to remain ativated so that the leading edge of the moving top sheet is in the desired position after being moved even if the top sheet is skewed initially. The position of the driven belt units relative to each other is adjustable so that the apparatus can accommodate varying sized document sheets.

DESCRIPTION OF SPECIFIC EMBODIMENTS

Figure 1:
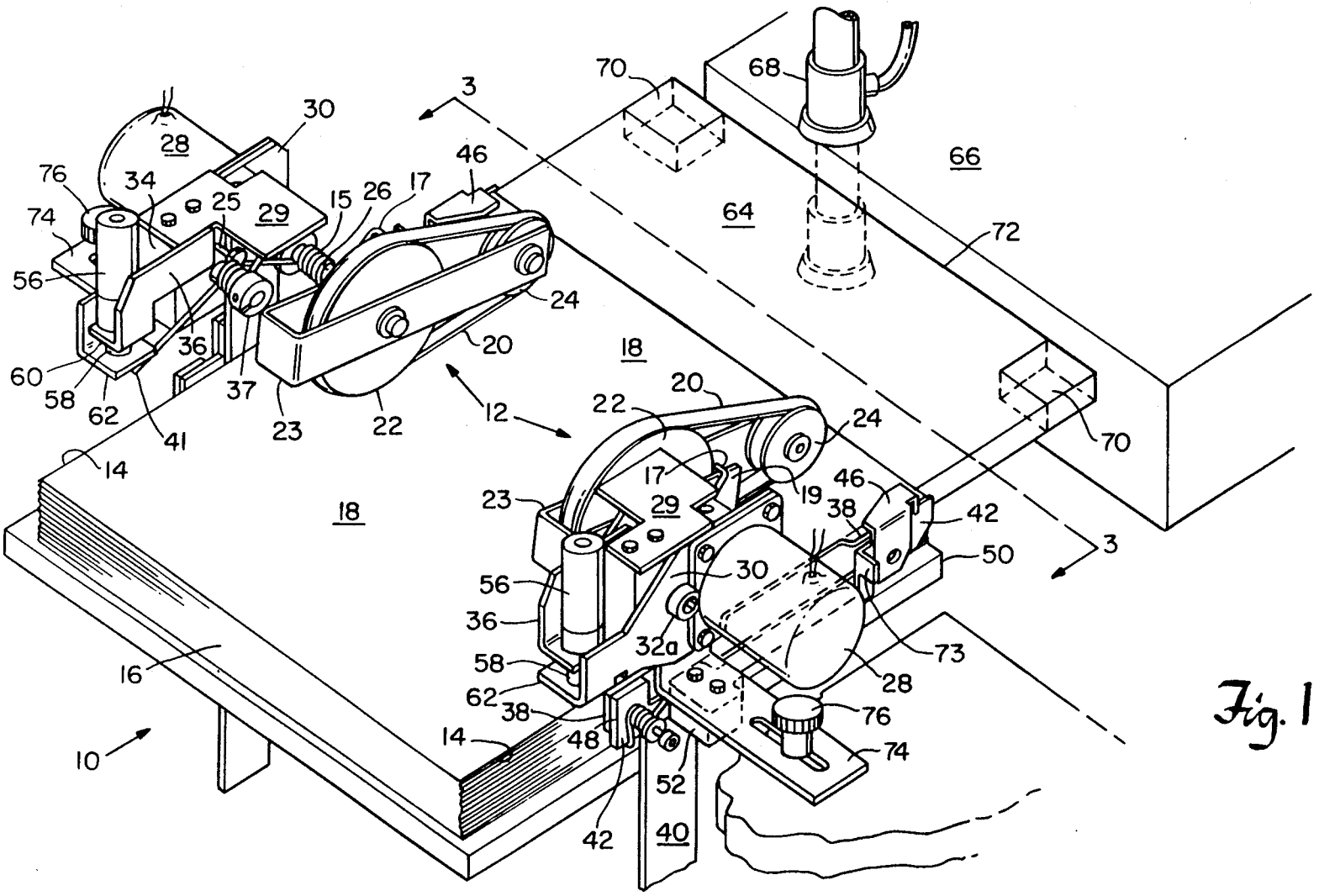
FIG. 1 is an isometic view of the apparatus of this invention.
Figure 2:
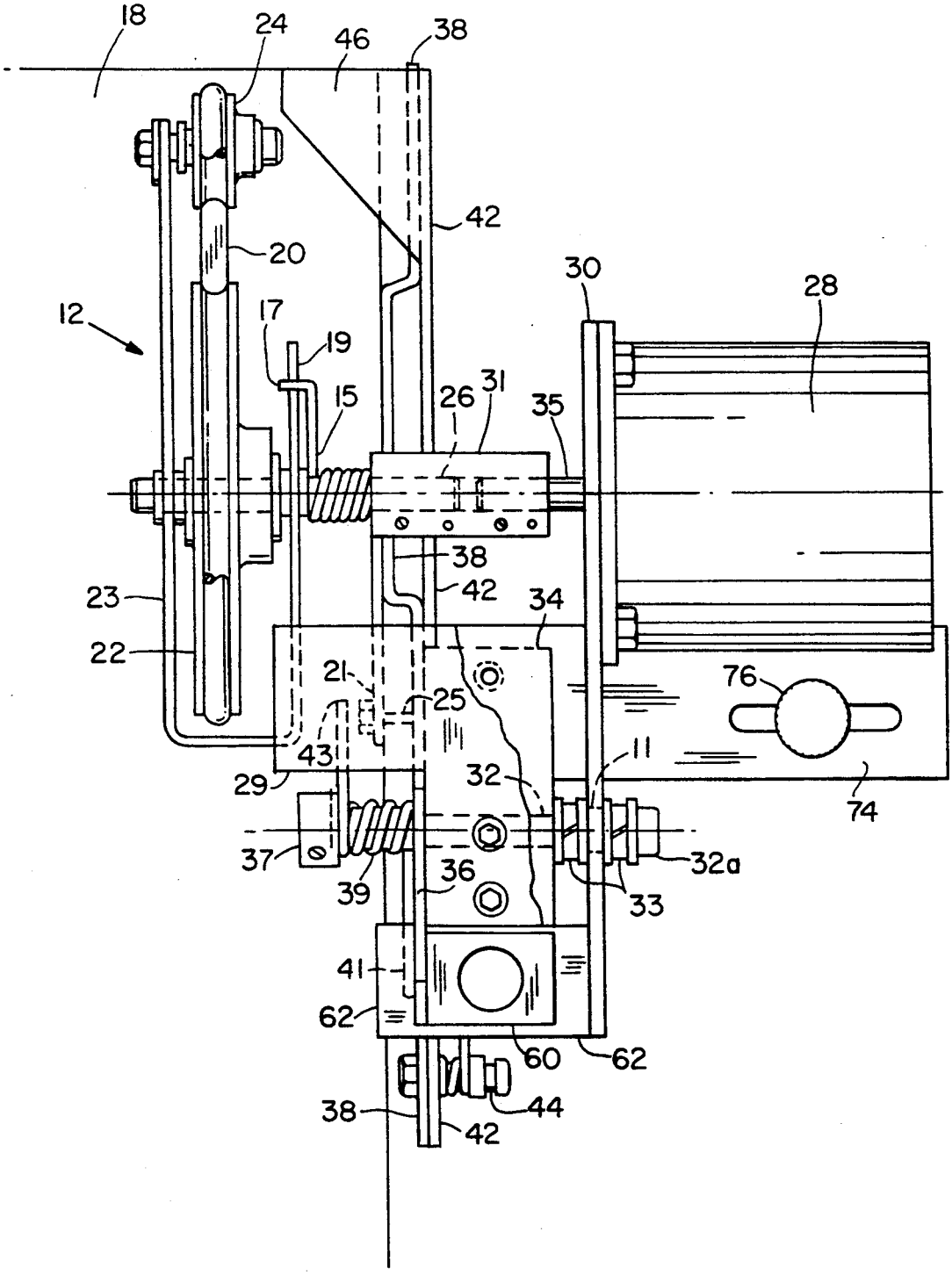
FIG. 2 is a top view of one-half of the apparatus of FIG. 1.
Figure 3:
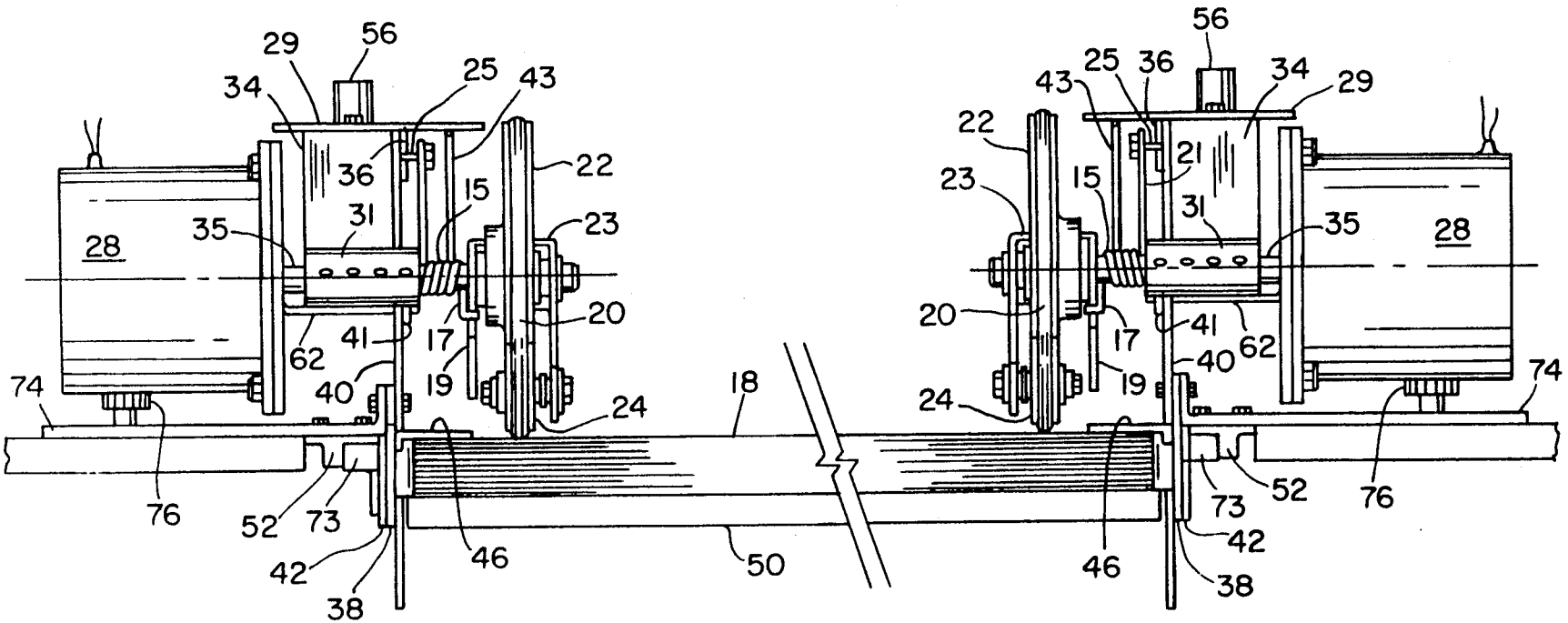
FIG. 3 is a front view of the apparatus of FIGS. 1 and 2 taken along line 3—3 of FIG. 1.

The document feeder apparatus of this invention 10 includes two drive belt units 12 positioned adjacent opposing parallel edges 14 of a stack of document sheets 16. The top sheet 18 is in direct contact with belts 20 of driven belt units 12. Belts 20 are positioned about driven wheel 22 and idle wheel 24. Driven wheel 22 is mounted within bracket 23 and on shaft 26 which is connected to motor 28 through rigid shaft coupling 31 having set screw 13. Coupling 31 fits on shaft 35 of motor 28. Bracket 30, in turn, is pivotally mounted on shaft 32 which extends through hole 11 in bracket 30 and is held thereto by nut 37. A spring 15 is mounted on shaft 26. One end 17 of spring 15 is positioned on the top surface 19 of bracket 23 and the second end 21 of spring 17 is positioned on shaft 25 which fits into hole 27 of block 34 and is held thereto by any conventional means such as a nut and screw arrangement. Block 34 is secured to vertical support 40. Spring 15 functions to bias belt unit 12 toward the stack of sheets 16 so that the entire surface of belt 20 between rollers 22 and 24 adjacent to the top sheet 18 contacts the top sheet 18. This arrangement minimizes or prevents the top sheet 18 from pivoting about a portion of the belt and thereby prevents skewing of the top sheet. When the motor 28, bracket 30 and belt unit 12 are pivoted about shaft 32 and away from the top sheet 18, the degree of upward rotation is limited by stop 29 which contacts bracket 30 when bracket 23 is pivoted away from top sheet 18. Bracket 30 is pivotally mounted on shaft 32. Bearing 33 and nut 37 retain spring 39 and bracket 30 on shaft 32. One end 43 of spring 39 is positioned under stop 29 while a second end 41 of spring 39 is positioned under surface 62 of bracket 30. Spring 39 is optional but provides the advantage of permitting adjustment of the force with which belt unit 12 contacts the top sheet 18. Bracket 38 is fixedly mounted on vertical support 40 and is in contact with edge 14 of the stack 16. Bracket 42 is pivotally mounted on shaft 44. Bracket 42 also is mounted with a spring (not shown), so that it returns to the position shown in FIG. 1 when not under force from the stack 16. The bracket 42 has a lip 46 which contacts the top sheet 18 of stack 16. Stack 16 is positioned on an elevator platform 50 which moves vertically by means of a motor (not shown). When the platform 50 is elevated, it will push top sheet 18 into contact with lip 46 of bracket 42 to pivot bracket 42 about shaft 44 until the bracket 73 moves away from optical switch 42. Optical switch 52 effects deactivation of the motor (not shown) which governs the vertical position of elevator platform 50 and stack 16. The top sheet 18 is in contact with belts 20 when it is desired to move sheet 18 away from the stack 16. A fluid activated punch 56 having a leading edge 58 is mounted through a hole through surface 60. The leading edge 58 is moved into contact with surface 62 of bracket 30 in order to pivot bracket 30 about shaft 32 in different vertical positions. Any means for applying force to surface 60 can be utilized however, it is preferred to employ a fluid activated means (pneumatic or hydraulic) for ease of control.

The stack 16 is positioned adjacent shelf 64, which in turn, is positioned adjacent a desired end surface 66 for the sheet 18 such as the surface of a box 66. A source of vacuum 68 is positioned adjacent shelf 64. Optical switches 70 are provided adjacent the leading edge 72 of shelf 64. A bracket 74 having knob screw 76 provides a means for moving the two drive belt units away from or toward each other to accommodate sheets of varying widths.

In operation, the elevator platform 50 with the stack 16 is moved vertically until sheet 18 contacts lip 46 of bracket 42. Bracket 42 then is pivotally moved until bracket 73 moves away from switch 52 to deactivate the elevator motor (not shown). The knob screws 76 have been previously set so that lip 46 will contact the top sheet 18 when the stack 16 is elevated. When it is desired to move the top sheet 18 onto shelf 64, fluid activator 56 is raised to allow the motor 28 and drive belt unit 12 to pivot toward top sheet 18 until the portion of the belt 20 between rollers 22 and 24 contacts sheet 18. It is desired to effect contact of the entire length of the belt 20 between 22 and 24 in order to eliminate pivoting of the top sheet about a point on the belt 20. The entire weight of the drive belt unit 12 not otherwise supported by shaft 32 will rest on top sheet 18, including the force applied by spring 15. This pivoting arrangement is desirable since the entire weight of the drive belt unit 12 not otherwise supported by shaft 32 always will rest on top sheet 18 regardless of variation in the height of the top sheet 18 relative to the platform 50. This permits a constant reproducible friction driving force from each of the belts 20 so that top sheet 18 can be moved without skewing it. Top sheet 18 moves onto shelf 64 until its leading edge 80 obscures the optical switches 70 from the ambient light. When the switches 70 are obscured from the ambient light, they cause the motor to stop, thereby stopping belts 20 and to position top sheet 18 below the source of vacuum 68. If the top sheet 18 is skewed, so that only one optical sensor is covered, the motor 28 controlling the skewed leading edge 18 will stop while the second motor 28 controlling the lagging leading edge 18 will continue to function until the second optical sensor 70 is covered by the top sheet 18. By operating in this manner, it is assured that the leading edge of top sheet 18 will be positioned square to the box 66 when it is desired to move the top sheet 18 to the box 66 (to which glue has been previously applied). Thus, the use of two independent motors 28 is required to assure proper position of the sheet 18. After sheet 18 is positioned correctly on shelf 64, the source of vacuum 68 is lowered to lift sheet 18 away from the shelf 64. Contemporaneous with lowering the vacuum source 68, fluid activator 56 is activated to lower leading surface 58 which shelf 62 to pivot bracket 30 and lift belt driven unit 12 away from contact with sheet 18. Since the belts 20 are no longer in contact with sheet 18. The source of vacuum 68 can lift the sheet 18 away from shelf 64 and stack 16 to the box 66 where it is secured thereto with the previously applied adhesive. The position of the fluid actuator 56 and the vacuum source 68 can be operated independently or with a common control source such as a standard microprocessor. However, all that is necessary is that the belt drive unit 12 and sheet 18 be lifted away from stack 16 simultaneously to avoid sheet damage. The vacuum source 68 and fluid activator 56 then are lifted simultaneously away from the stack 16 so that the belts 20 contact the next adjacent sheet at the top of the stack in the same manner described above and the cycle described above is repeated.

We claim:

1. Apparatus for feeding document sheets seriatum from a stack of said document sheets which comprises:

two pivotally mounted driven belt means positioned spaced apart from each other adjacent parallel edges of said stack, fluid activated means for pivotally moving said belt means (a) into contact with a top sheet on said stack or (b) away from contact with said stack, two motor means wherein one of said motor means is connected to one of said belt means, and means for independently activating and deactivating said two motor means comprising means for sensing the position of said top sheet.

2. The apparatus of claim 1 including means for varying the distance between said driven belt means.

3. The apparatus of any one of claims 1 or 2 wherein said means for independently activating and deactivating said two motor means comprises optical sensors.

4. The apparatus of any one of claims 1 or 2 wherein said means for independently activating and deactivating said two motor means comprises optical sensors positioned to sense the position of a leading edge of said top sheet after said top sheet has been removed from said stack.

5. The apparatus of any one of claims 1 or 2 wherein including means for sensing the vertical position of said stack.

6. The apparatus of any one of claims 1 or 2 including vacuum means for moving said top sheet subsequent to moving said belt means from contact with said stack.

* * * * *